US010991325B2

(12) United States Patent
Lin

(10) Patent No.: US 10,991,325 B2
(45) Date of Patent: Apr. 27, 2021

(54) BACKLIGHT SIGNAL PROCESSING METHOD AND DISPLAY DEVICE

(71) Applicant: AU Optronics Corporation, Hsin-Chu (TW)

(72) Inventor: Hui-Feng Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/860,800

(22) Filed: Apr. 28, 2020

(65) Prior Publication Data

US 2020/0388234 A1 Dec. 10, 2020

(30) Foreign Application Priority Data

Jun. 5, 2019 (TW) ..... 108119566

(51) Int. Cl.
*G09G 3/36* (2006.01)

(52) U.S. Cl.
CPC ..... *G09G 3/3607* (2013.01); *G09G 3/3648* (2013.01); *G09G 2320/0626* (2013.01); *G09G 2320/0666* (2013.01)

(58) Field of Classification Search
CPC ... G09G 2320/0271; G09G 2320/0626; G09G 2320/0666; G09G 2360/16; G09G 3/3426; G09G 3/3607; G09G 3/3648
USPC ..... 345/1.1, 55, 88, 589, 690–698
See application file for complete search history.

(56) References Cited

U.S. PATENT DOCUMENTS 8,698,859 B2 * 4/2014 DeLuca ..... G09G 5/391 345/698
2007/0041054 A1 * 2/2007 Kakutani ..... H04N 1/4105 358/3.16
2008/0108393 A1 * 5/2008 Kim ..... G02F 1/167 455/566
2008/0129677 A1 * 6/2008 Li ..... G09G 3/3426 345/102
2009/0096710 A1 * 4/2009 Raman ..... G09G 3/3426 345/1.1
2010/0328336 A1 * 12/2010 Si ..... G09G 3/3666 345/589
2011/0037784 A1 * 2/2011 Shiomi ..... G09G 3/3426 345/690

(Continued)

FOREIGN PATENT DOCUMENTS

CN 1484453 A 3/2004
CN 108761888 A 11/2018

*Primary Examiner* — Tony O Davis
(74) *Attorney, Agent, or Firm* — WPAT, PC

(57) ABSTRACT

A backlight signal processing method is suitable for a display device including a backlight module and a LCD panel, wherein the number of multiple emitting areas of the backlight module is smaller than the number of multiple pixels of the LCD panel. The backlight signal processing method includes: generating multiple first gray level data signals according to multiple color data signals; grouping the first gray level data signals to calculate multiple second gray level data signals, wherein the number of the second gray level data signals is smaller than the number of the first gray level data signals; multiplying a coefficient matrix to obtain multiple gray level matrices; performing an overlapping operation on the gray level matrices to obtain a backlight matrix; and controlling the emitting areas to display according to the backlight matrix respectively.

9 Claims, 16 Drawing Sheets

(56) References Cited

U.S. PATENT DOCUMENTS

| | | | | |
|---|---|---|---|---|
| 2012/0281028 | A1* | 11/2012 | Orlick | G09G 3/3426 345/690 |
| 2012/0293399 | A1* | 11/2012 | Haskin | G02F 1/134309 345/88 |
| 2016/0104412 | A1* | 4/2016 | Su | G09G 3/2074 345/55 |
| 2016/0260198 | A1 | 9/2016 | Hu et al. | |
| 2017/0061896 | A1* | 3/2017 | Zhang | G09G 3/3426 |
| 2017/0061897 | A1* | 3/2017 | Zhang | G09G 3/3426 |
| 2017/0061901 | A1* | 3/2017 | Zhang | G09G 3/3426 |
| 2017/0061902 | A1* | 3/2017 | Zhang | G09G 3/3426 |
| 2017/0084232 | A1* | 3/2017 | Yang | G09G 3/3406 |
| 2017/0110064 | A1* | 4/2017 | Zhang | G09G 3/2018 |
| 2017/0110065 | A1* | 4/2017 | Zhang | G09G 3/2018 |
| 2017/0212717 | A1* | 7/2017 | Zhang | G06F 3/1446 |
| 2017/0358253 | A1* | 12/2017 | Bonnier | G09G 3/2003 |
| 2018/0299726 | A1* | 10/2018 | Oka | G02F 1/133528 |
| 2018/0308429 | A1* | 10/2018 | Meng | G09G 3/3406 |
| 2019/0096341 | A1* | 3/2019 | Zha | G09G 3/3607 |
| 2019/0130852 | A1* | 5/2019 | Liao | G09G 3/3413 |
| 2019/0132489 | A1* | 5/2019 | Liao | G02F 1/133606 |
| 2019/0348001 | A1* | 11/2019 | Shi | G09G 3/3426 |
| 2020/0320941 | A1* | 10/2020 | Ge | G09G 5/10 |
| 2020/0320957 | A1* | 10/2020 | Zhang | G02F 1/133602 |
| 2020/0357362 | A1* | 11/2020 | Shin | G09G 3/3266 |

* cited by examiner

SA

| | | | | | | | | | |
|---|---|---|---|---|---|---|---|---|---|
| P11 | P12 | P13 | P14 | P15 | P16 | P17 | P18 | P19 |
| P21 | P22 | P23 | P24 | P25 | P26 | P27 | P28 | P29 |
| P31 | P32 | P33 | P34 | P35 | P36 | P37 | P38 | P39 |
| P41 | P42 | P43 | P44 | P45 | P46 | P47 | P48 | P49 |
| P51 | P52 | P53 | P54 | P55 | P56 | P57 | P58 | P59 |
| P61 | P62 | P63 | P64 | P65 | P66 | P67 | P68 | P69 |
| P71 | P72 | P73 | P74 | P75 | P76 | P77 | P78 | P79 |
| P81 | P82 | P83 | P84 | P85 | P86 | P87 | P88 | P89 |
| P91 | P92 | P93 | P94 | P95 | P96 | P97 | P98 | P99 |

Fig. 5A

BACKLIGHT SIGNAL PROCESSING METHOD AND DISPLAY DEVICE

RELATED APPLICATIONS

This application claims priority to Taiwan Application Serial Number 108119566, filed Jun. 5, 2019, which is herein incorporated by reference.

BACKGROUND

Technical Field

The disclosure relates to a backlight signal processing method and a display device, particularly to a backlight signal processing method and a display device for adjusting backlight brightness.

Description of Related Art

With development of technology, the demand for display devices becomes more and more extensive. Conventionally, liquid crystal displays (LCDs) may be used with dynamic backlight technology to increase contrast. However, limited by size, under the same number of backlight areas, backlight diffusion will be more serious than in the past, thus affecting the quality of the displayed image.

Therefore, how to improve the control method of the backlight signal to effectively improve the contrast of the image is the current design consideration and challenge.

SUMMARY

One aspect of the present disclosure is a backlight signal processing method suitable for a display device including a backlight module and a LCD panel, wherein the number of a plurality of emitting areas of the backlight module is smaller than the number of a plurality of pixels of the LCD panel. The backlight signal processing method including: generating a plurality of first gray level data signals according to a plurality of color data signals; grouping the first gray level data signals to calculate a plurality of second gray level data signals, wherein the number of the second gray level data signals is smaller than the number of the first gray level data signals; multiplying a coefficient matrix to obtain a plurality of gray level matrices; performing an overlapping operation on the gray level matrices to obtain a backlight matrix; and controlling the plurality of emitting areas to display according to the backlight matrix respectively.

One aspect of the present disclosure is an another backlight signal processing method, including: when an input image signal is input to a display device, converting, by the display device, the input image signal into an output image signal, where the resolution of the output image signal is less than the resolution of the output image signal; the input image signal comprising a first total number of pixels and a first high-brightness pattern, the output image signal comprising a second high-brightness pattern and a second total number of pixels which is lower than the first total number of pixels, a width of the pixel of the second high-brightness pattern is larger than a width of the pixel of the first high-brightness pattern.

Another aspect of the present disclosure is a display device. The display device includes a backlight module, a LCD panel, and a control circuit. The backlight module includes a plurality of emitting areas. The LCD panel includes a plurality of pixels. The number of plurality of pixels is larger than the number of the plurality of emitting areas. The control circuit is coupled to the backlight module and the LCD panel. The control circuit is configured to perform the following operations: generating a plurality of first gray level data signals according to a plurality of color data signals; grouping the plurality of first gray level data signals to calculate a plurality of second gray level data signals, wherein the number of the plurality of second gray level data signals is smaller than the number of the plurality of first gray level data signals; multiplying the plurality of second gray level data signals by a coefficient matrix to obtain a plurality of gray level matrices; performing an overlapping operation on the gray level matrices to obtain a backlight matrix; controlling the plurality of emitting areas to display according to the backlight matrix respectively; and controlling the plurality of pixels to display according to the plurality of color data signals respectively.

BRIEF DESCRIPTION OF THE DRAWINGS

FIG. 5A is a schematic diagram illustrating an enlarged input image in accordance with some embodiments of the disclosure.

DETAILED DESCRIPTION

The following embodiments are disclosed with accompanying diagrams for detailed description. For illustration clarity, many details of practice are explained in the following descriptions. However, it should be understood that these details of practice do not intend to limit the present disclosure. That is, these details of practice are not necessary in parts of embodiments of the present disclosure. Furthermore, for simplifying the diagrams, some of the conventional structures and elements are shown with schematic illustrations.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments.

In this document, the term "coupled" may also be termed "electrically coupled," and the term "connected" may be termed "electrically connected." "Coupled" and "connected" may also be used to indicate that two or more elements cooperate or interact with each other.

Figure 1:
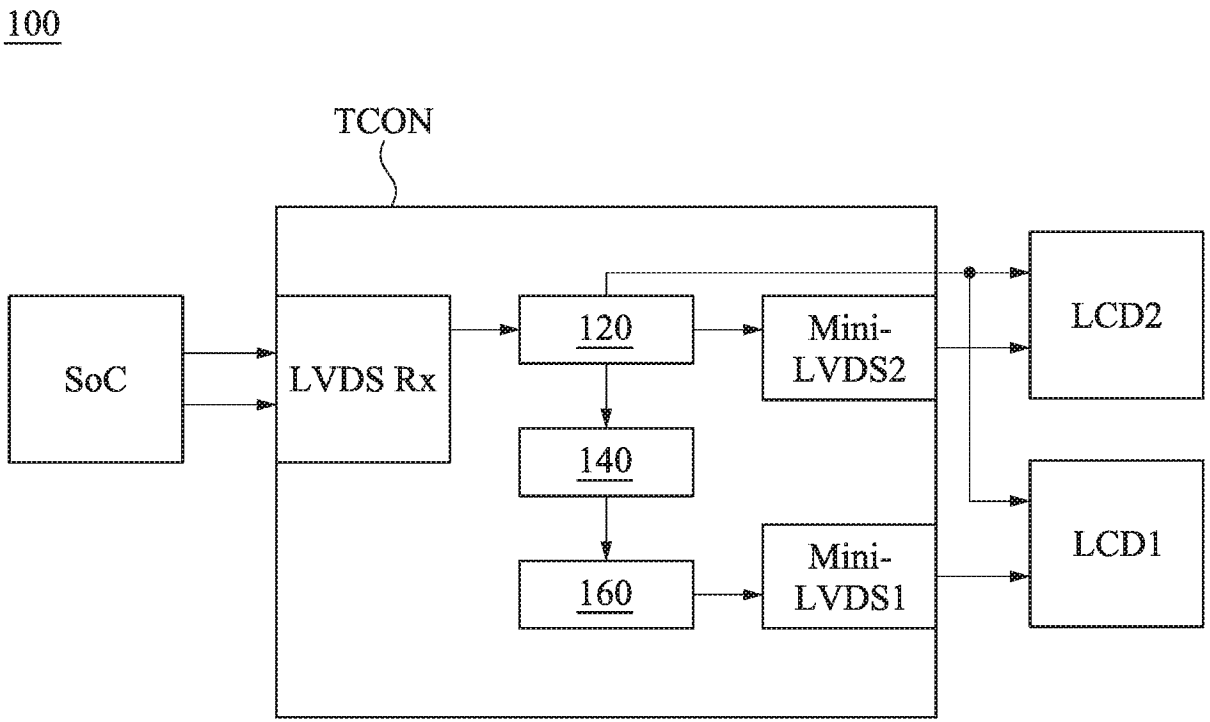
FIG. 1 is a schematic diagram illustrating a display device in accordance with some embodiments of the disclosure.

Please refer to FIG. 1. FIG. 1 is a schematic diagram illustrating a display device 100 in accordance with some embodiments of the disclosure. As shown in FIG. 1, the display device 100 includes a system-on-a-chip SoC, a control circuit TCON, a LCD panel LCD1 and a LCD panel LCD2. In some embodiments, the control circuit TCON includes a timing controller 120, an operational circuit 140 and an operational circuit 160.

In structure, the system-on-a-chip SoC is coupled to the control circuit TCON, the control circuit TCON is coupled to the LCD panel LCD1 and the LCD panel LCD2. Specifically, the system-on-a-chip SoC is coupled to the timing controller 120 through a low-voltage differential signal receiving interface LVDS_Rx, the timing controller 120 is coupled to the LCD panel LCD1, the LCD panel LCD2 and the operational circuit 140, and the operational circuit 140 is coupled to the operational circuit 160. In addition, the timing controller 120 is coupled to the LCD panel LCD2 through a low-voltage differential signal transmitting interface Mini-LVDS2, the operational circuit 160 is coupled to the LCD panel LCD1 through a low-voltage differential signal transmitting interface Mini-LVDS1.

Operationally, the system-on-a-chip SoC outputs a low-voltage differential signal to timing controller 120 of the control circuit TCON through the low-voltage differential signal receiving interface LVDS_Rx of the control circuit TCON. The timing controller 120 output a clock signal to the LCD panel LCD1 and the LCD panel LCD2. On the other hand, the timing controller 120 transmits color data signals to the operational circuit 140 and the operational circuit 160, and performs operation according to a backlight signal processing method. The operational circuit 160 generates corresponding driving signals according to the operation results, and output the corresponding driving signals to the LCD panel LCD1 through the low-voltage differential signal transmitting interface Mini-LVDS1, so that the LCD panel LCD1 displays according to the corresponding driving signals. In addition, the timing controller 120 generates the corresponding driving signals according to the color data signals, and output the color data signals to the LCD panel LCD2 through the low-voltage differential signal transmitting interface Mini-LVDS2, so that the LCD panel LCD2 displays according to the driving signals corresponding to the color data signals.

Figure 2A:
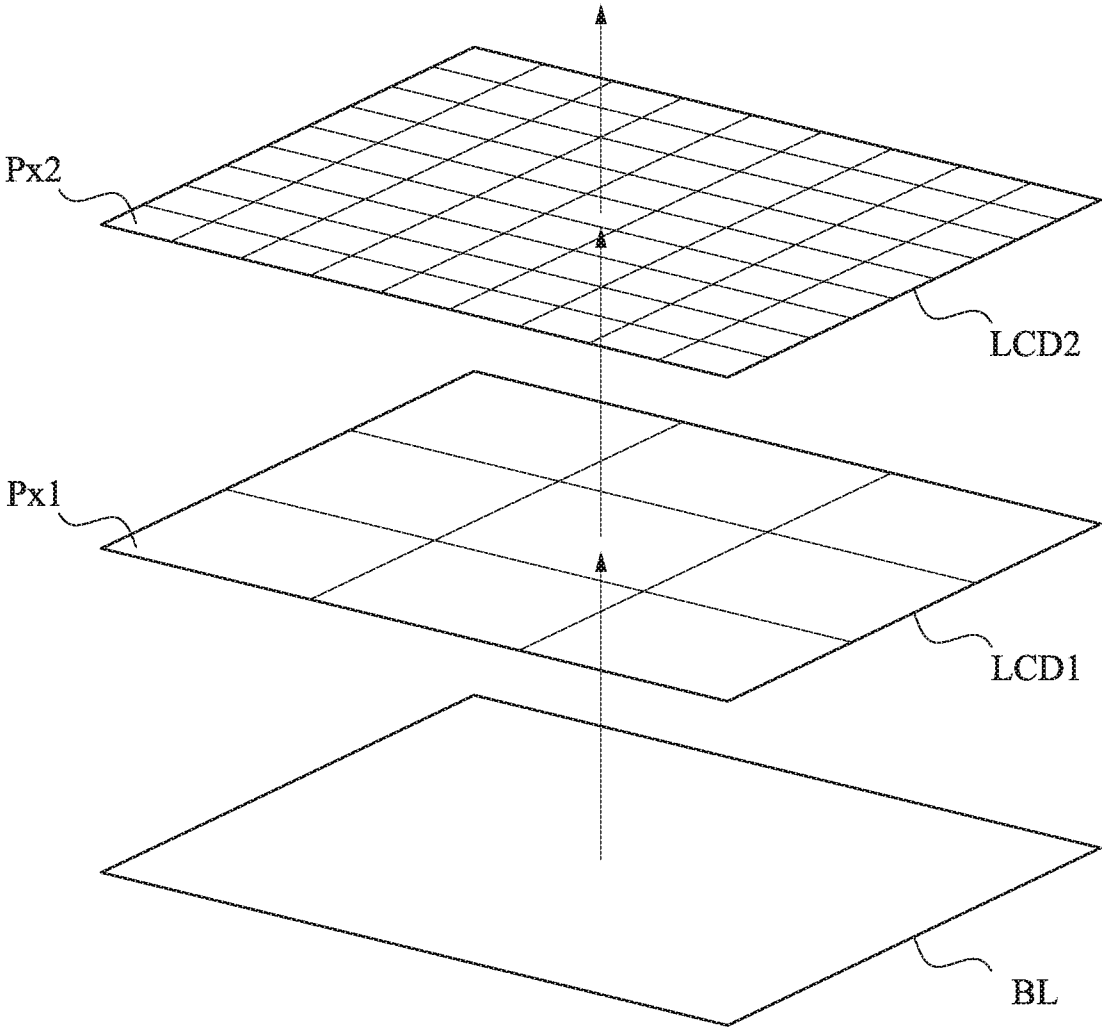
FIG. 2A is a schematic diagram illustrating a LCD panel in accordance with some embodiments of the disclosure.

In some embodiments, as shown in FIG. 2A, the backlight module is formed by the LCD panel LCD1 and a backlight component BL. The LCD panel LCD1 is arranged above the backlight component BL, and the LCD panel LCD2 is arranged above the LCD panel LCD1. In other words, as shown in FIG. 2A, the beams emitted by the backlight component BL enter the LCD panel LCD2 through the LCD panel LCD1, and then be emitted from the LCD panel LCD2 for display. Specifically, the LCD panel LCD1 does not include a color filter and merely includes a LCD array and a polarizer. The LCD panel LCD1 is configured to drive the liquid crystal array to control the ratio of light penetration according to the corresponding driving signal to display different gray levels of brightness. The LCD panel LCD2 includes a LCD array, red, green, blue filters and a polarizer. The LCD panel LCD2 is configured to drive the liquid crystal array according to the corresponding driving signal to display the corresponding color and brightness. In this way, by controlling the LCD panel LCD1, the brightness of the backlight entering to the different areas of the LCD panel LCD2 is able to be adjusted.

In the present embodiment, the resolution of the LCD panel LCD1 is smaller than the resolution of the LCD panel LCD2. For example, as shown in FIG. 2A, the nine pixels of the LCD panel LCD2 (e.g., pixel Px2 shown in FIG. 2A) corresponds to one area of the panel LCD1 (e.g., pixel Px1 shown in FIG. 2A). In other words, the length and width of one pixel in the LCD panel LCD2 (e.g., pixel Px2 shown in FIG. 2A) is equivalent to one-third long and one-third wide of one area in the LCD panel LCD1 (e.g., pixel Px1 shown in FIG. 2A). That is, the number of the pixels of the LCD panel LCD2 is larger than the number of the areas of the LCD panel LCD1 (e.g., the number of the pixel Px2 shown in FIG. 2A, which is 81, is larger than the number of the pixel Px1, which is 9).

It should be noted that, the number or the size of the pixels and areas included by the LCD panel LCD1 and the LCD panel LCD2 may be adjusted based on the actual requirements, and FIG. 2A is merely an example, not intended to limit the present disclosure.

In this way, with the lower resolution LCD panel LCD1, the transmittance of the backlight source is able to be increased, therefore, under the same brightness requirements, the backlight brightness required by the backlight component BL is able to be scaled down, so that the backlight component BL is less likely to overheat. Furthermore, the lower resolution of the LCD panel LCD1 is able to reduce the amount of image data calculation and reduce the cost of hardware circuits.

Figure 2B:
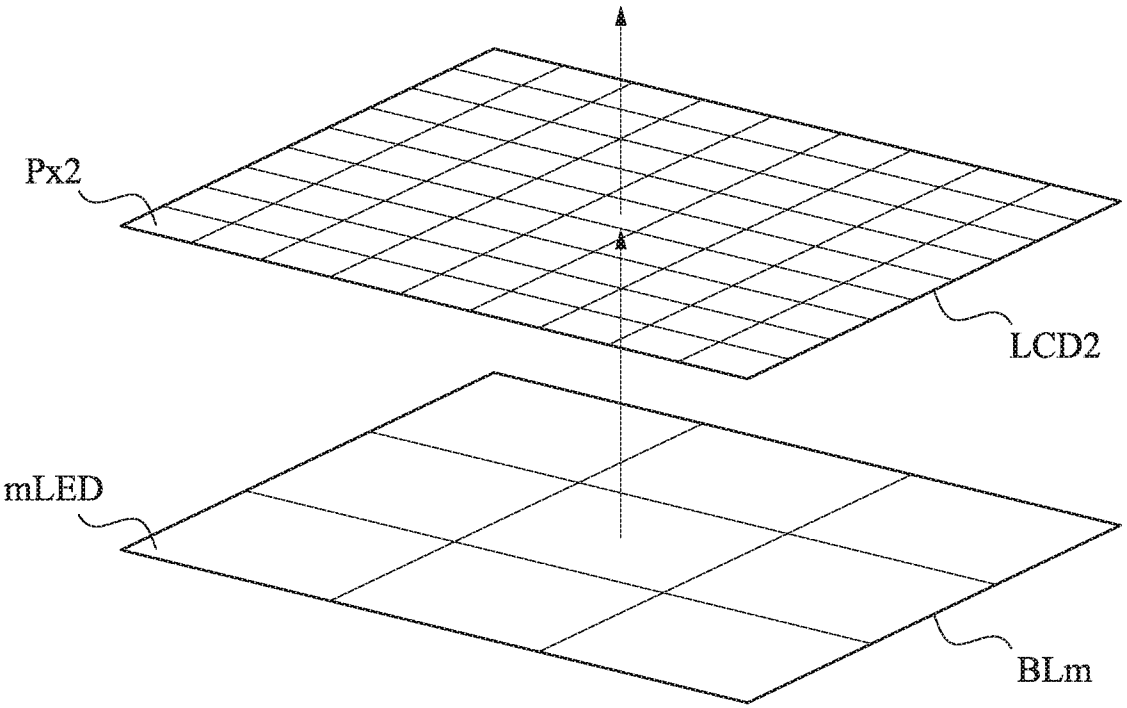
FIG. 2B is a schematic diagram illustrating another LCD panel in accordance with some embodiments of the disclosure.

In some embodiments, the LCD panel LCD1 and the LCD panel LCD2 may be a general flat panel or a curved panel, and the backlight component BL may be a general backlight component or a backlight component with local dimming. In some other embodiments, as shown in FIG. 2B, the display device 100 may include a mini LED backlight component BLm with local dimming function and the LCD panel LCD2. The backlight module is the backlight component BLm. The multiple pixels of the LCD panel LCD2 corresponds to one emitting region of the backlight module BLm. For example, the nine pixels of the LCD panel LCD2 (e.g., pixel Px2 shown in FIG. 2B) corresponds to one emitting region of the backlight module BLm (e.g. emitting region mLED shown in FIG. 2B).

In some embodiments, control circuit TCON may be realized by various processing circuit, a micro controller, a center processor, a microprocessor, a digital signal processor (DSP), an application specific integrated circuit (ASIC), a complex programmable logic device (CPLD), a field-programmable gate array (FPGA) or logic circuit, etc.

Figure 3:
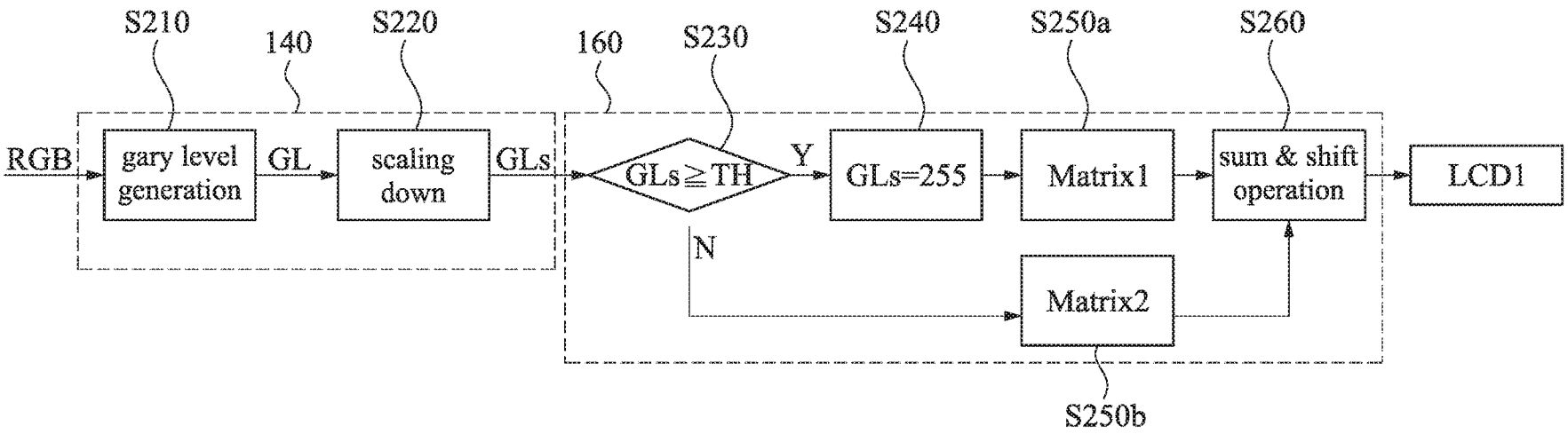
FIG. 3 is a function block diagram illustrating a backlight signal processing method in accordance with some embodiments of the disclosure.

About the detail of the backlight signal processing method, please refer to FIG. 3. FIG. 3 is a function block diagram illustrating a backlight signal processing method in accordance with some embodiments of the disclosure. As shown in FIG. 3, the backlight signal processing method is mainly performed by the operational circuit 140 and the operational circuit 160 in FIG. 1. The following backlight signal processing method is described in accompanying with the embodiments shown in FIG. 1 to FIG. 7, but not limited thereto. Various alterations and modifications may be performed on the disclosure by those of ordinary skilled in the art without departing from the principle and spirit of the disclosure. The backlight signal processing method includes operations S210, S220, S230, S240, S250*a*, S250*b* and S260.

Firstly, in operation S210, the operational circuit 140 receives the color data signals RGB, and performs calculation according to the color data signals RGB to generate the gray level data signals GL. Specifically, the total number of the pixels of the input image received by the display device 100 is equal to the number of the pixels of the LCD panel LCD2, and each pixel of the input image corresponds to one of the multiple color data signals RGB. Any one of the color data signals RGB includes a red data value, a green data value and a blue data value. The operational circuit 140 is configured to take the largest one of the red data value, the green data value and the blue data value to be a gray level data signal GL corresponding to the color data signal RGB. For example, when the color data signal RGB of the first pixel of the input image includes the red data value 56, the green data value 25 and the blue data value 230, the operational circuit 140 will take the blue data value 230 as the gray level data signal GL of the first pixel. In other words, through the operation S210, the operational circuit 140 converts the color input image into the gray-level image signal.

Next, in operation S220, the operational circuit 140 samples the gray level data signals to reduce the image resolution and transmits the lower resolution image signals to the operational circuit 160. Specifically, the operational circuit 140 converts the gray level data signals GL corresponding to the number of the pixels of the LCD panel LCD2 (e.g., 1920×720) into the gray level data signals GLs corresponding to the number of the areas of the LCD panel LCD1 (e.g., 640×240). The number of the areas of the LCD panel LCD1 is smaller than the number of the pixels of the LCD panel LCD2, that is, the number of the gray level data signals GLs is smaller than the number of the gray level data signals GL (i.e., the total number of the pixels of the input image).

Figure 4:
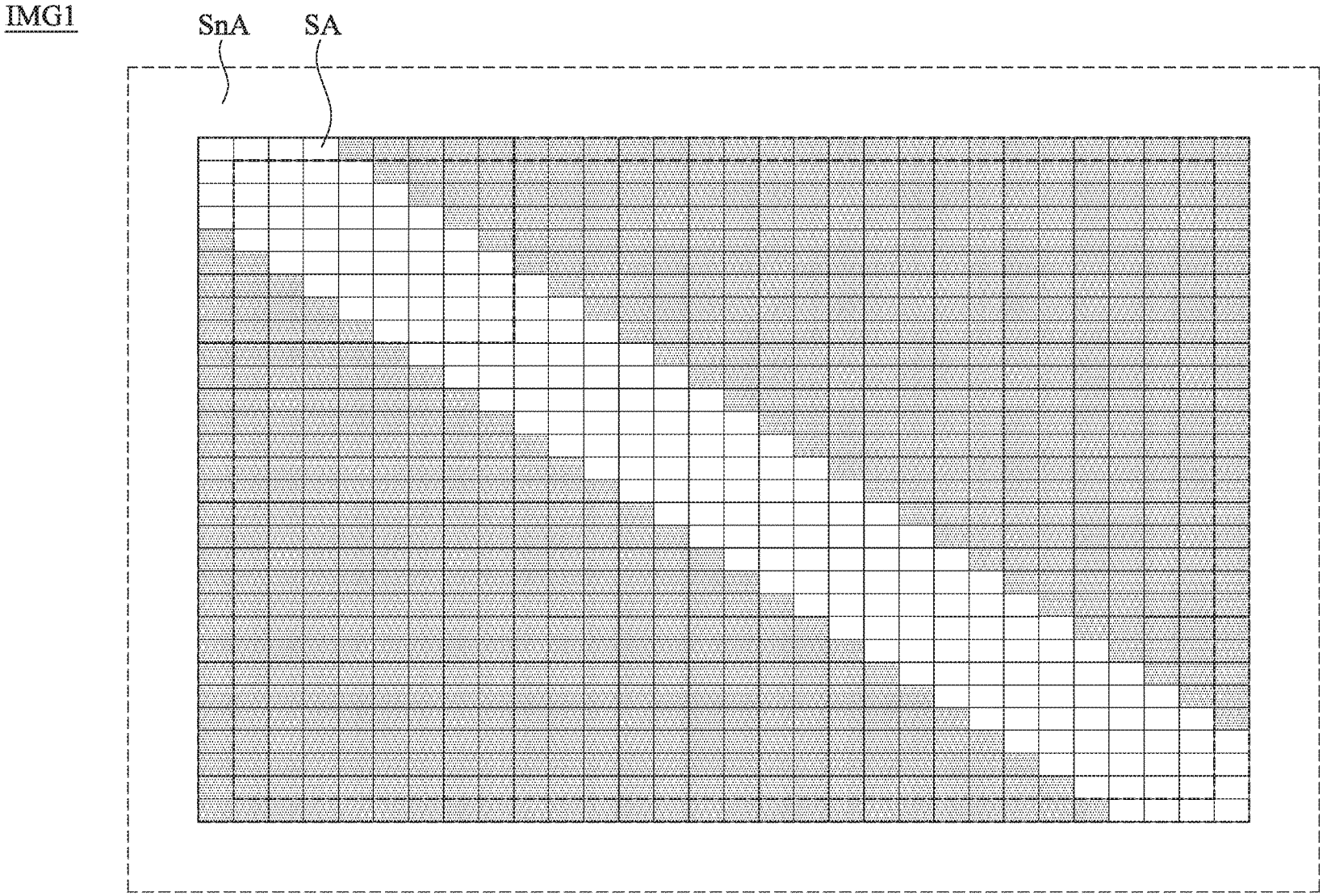
FIG. 4 is a schematic diagram illustrating an input image in accordance with some embodiments of the disclosure.
Figure 5B:
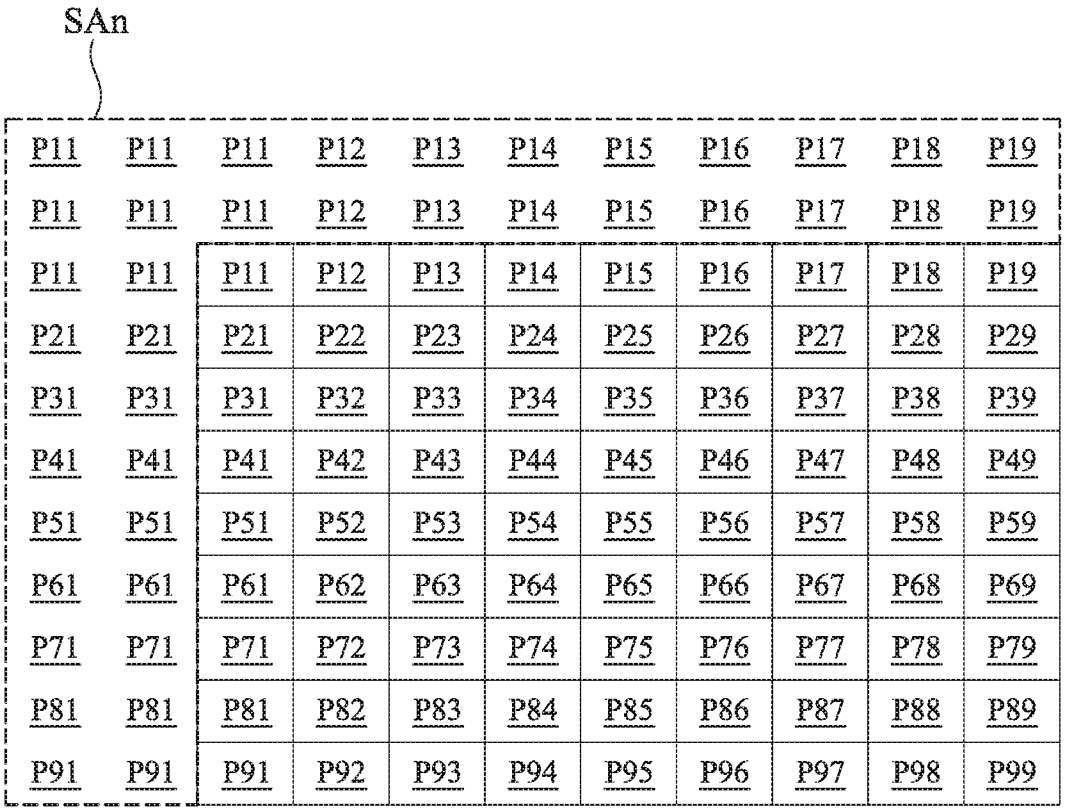
FIG. 5B is a schematic diagram illustrating an enlarged mirror area in accordance with some embodiments of the disclosure.
Figure 5C:
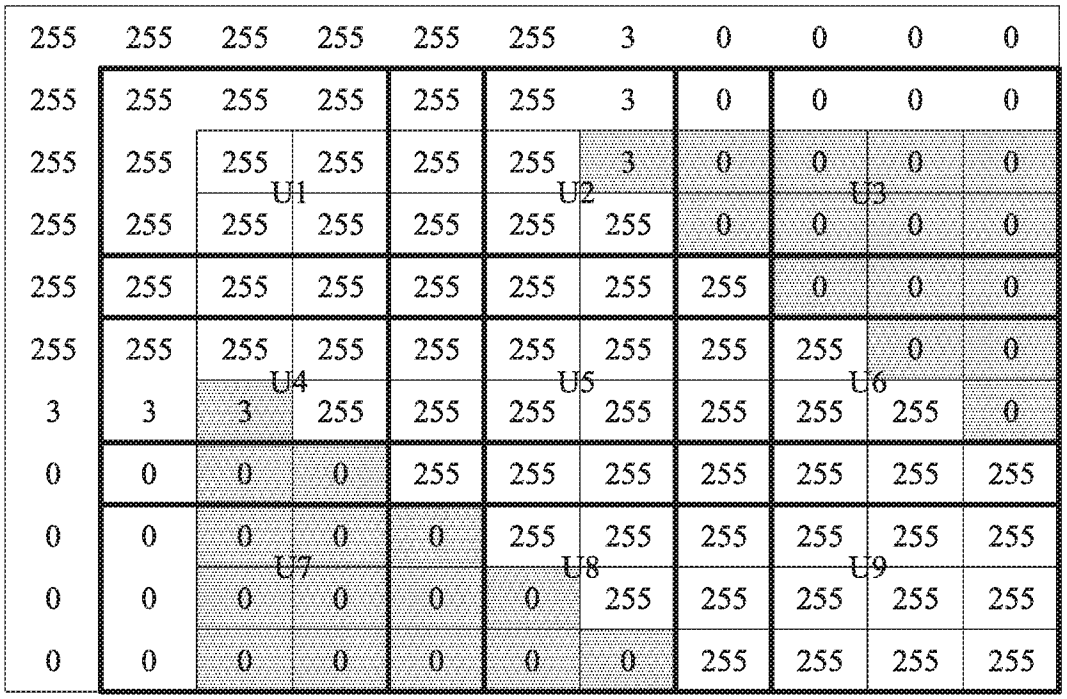
FIG. 5C is a schematic diagram illustrating grouping gray level data signals in accordance with some embodiments of the disclosure.

Please refer to FIG. 4 and FIG. 5A to FIG. 5D. FIG. 4 is a schematic diagram illustrating an input image IMG1 in accordance with some embodiments of the disclosure. FIG. 5A is a schematic diagram illustrating an enlarged input image IMG1 in accordance with some embodiments of the disclosure. As shown in FIG. 5A, take the 81 pixels P11~P99 in the upper left corner of the input image IMG1 shown in FIG. 4 as an example, each pixel P11~P99 corresponds to one of the gray level data signal GL (as shown in FIG. 5C). The operational circuit 140 mirrored copies the gray level data signals of all gray level data signals GL in the input image IMG1 located in the surrounding area (e.g., area SA in FIG. 4) to the mirrored area (e.g., area SAn in FIG. 4). For example, please refer to the enlarged FIG. 5A and FIG. 5B. The operational circuit 140 copies the gray level data signals corresponding to the pixels P11~P19 and P21~P91 located in the surrounding area SA to the mirrored area SAn to form a virtual image larger than the original input image IMG1.

To further illustrate, the operational circuit 140 selects first pixels from the outside to the inside in the X direction and the Y direction of the pixel matrix area SA, and copies their gray level values and fills in the mirrored pixel area SAn adjacent to the pixel matrix area SA. For example, if the widths of the row and the column of the mirrored pixel area SAn are both 2, then there are 8 pixels adjacent to the matrix position (1,1), so when the pixel gray level at the matrix position (1,1) is P11, then the 8 pixels may be filled into the gray level P11. It should be noted that the rows and columns of the pixels in the mirror image area may be designed according to actual requirements. In this embodiment, the widths of the rows and columns are both 2 as merely examples, not intended to limit the present disclosure.

In this way, by copying the gray level data signals of the surrounding area to generate a relatively enlarged virtual image, when the edges of the multiple spliced LCD panels are being calculated, the calculated values will not be biased high because they exceed the original input image range, so as to avoid the situation that bright lines appear on the splicing edge of the display device.

Figure 5D:
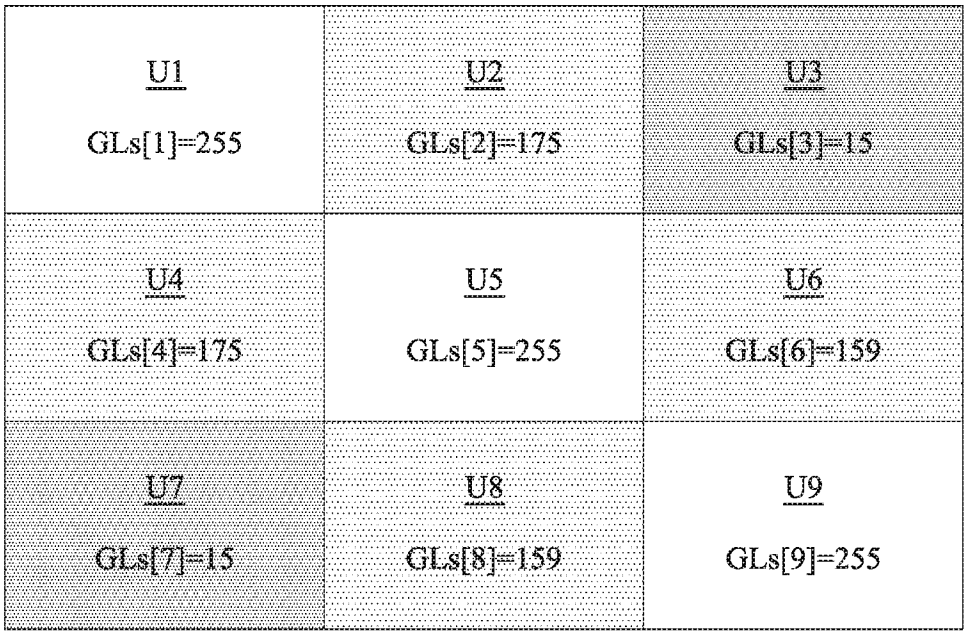
FIG. 5D is a schematic diagram illustrating operation results for scaling down in accordance with some embodiments of the disclosure.

Then, the operational circuit 140 groups the gray level data signals GL in the virtual image according to different neighboring pixels (e.g., pixel groups U1 to U9 in FIG. 5C). For example, in the present embodiment, 4×4 adjacent pixels are used for grouping, and adjacent pixel groups are overlapping sampled from each other in a row of pixels. For example, the pixel group U5 includes the pixels P33~P66, and the pixel group U6 includes the pixels P36~P69. The pixels P36~66 are repeatedly grouped and sampled. Furthermore, the operational circuit 140 sums up and averages the gray level data signals GL located in the same pixel group U1~U9 to generate corresponding gray level data signals GLs [1]~GLs [9]. For example, as shown in FIG. 5D, the gray level data signals GL of the pixels P33 to P66 in the pixel group U5 are summed up to obtain the gray level data signal GLs [5] as 255. For another example, the gray level data signals GL of the pixels P36 to P69 in the pixel group U6 are summed up to obtain the gray level data signal GLs [6] as 159.

It should be noted that, the above averaging the gray level data signals GL to obtain the gray level data signals GLs is merely an example for illustration, and is not intended to limit the present disclosure. Those skilled in art may adjust according to actual requirements. For example, in some other embodiments, the 16 gray level data signals of the same pixel group may be multiplied by different weights according to different positions, and then be averaged to obtain the gray level data signal.

In this way, after operation S220, the operational circuit 140 converts the gray-level input image of the original resolution into a gray-level image signal of the lower resolution. Since the calculation in the present embodiment is simple, the operation cost will not be increased. In addition, since the image data signals corresponding to pixels are sampled with similar weights, all the brightness data in the image can be retained evenly, and will not disappear during the operation process due to the too small image details.

Next, please keep referring to FIG. 3, in operation S230~S260, the operational circuit 160 receives the gray level data signals GLs from the operational circuit 140 and performs calculation to obtain a backlight matrix, and generates the corresponding driving signals according to the backlight matrix to output to the LCD panel LCD1 so as to control the areas of the LCD panel LCD1 to display.

In operation S230, the operational circuit 160 determines whether the gray level data signals GLs are larger than or equal to a brightness threshold TH. When the gray level data signals GLs are larger than or equal to the brightness threshold TH, in operation S240, the operational circuit 160 adjusts the gray level data signals GLs to the maximum brightness value (e.g., 255), and in the operation S250*a*, the operational circuit 160 multiplies the maximum brightness value by a coefficient matrix Matrix1 to obtain the corresponding gray-level matrix. When the gray level data signals GLs are smaller than the brightness threshold TH, in operation S250*b*, the operational circuit 160 multiplies the gray level data signals GLs by a coefficient matrix Matrix2 to obtain the corresponding gray-level matrix.

Figure 6A:
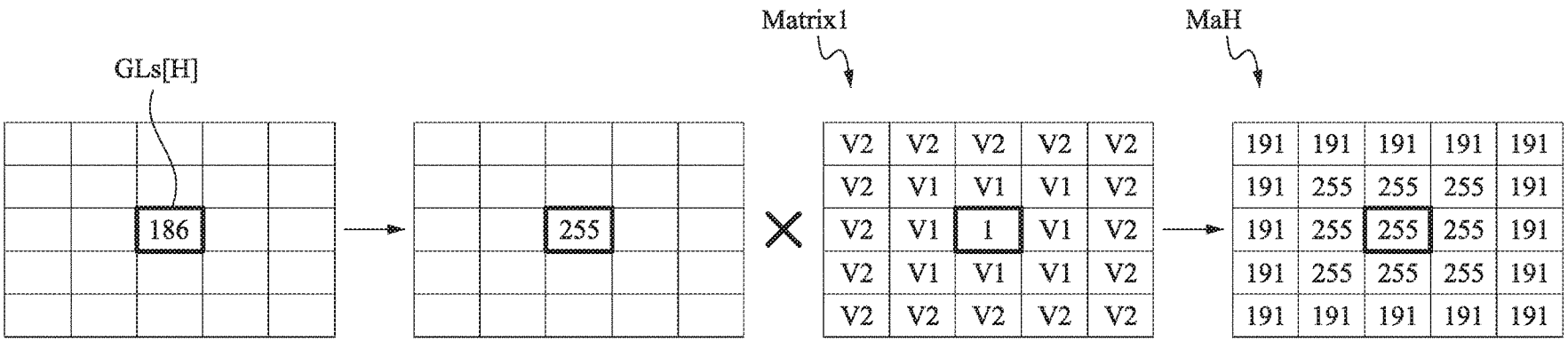
FIG. 6A is a schematic diagram illustrating generating a gray-level matrix in accordance with some embodiments of the disclosure.
Figure 6B:
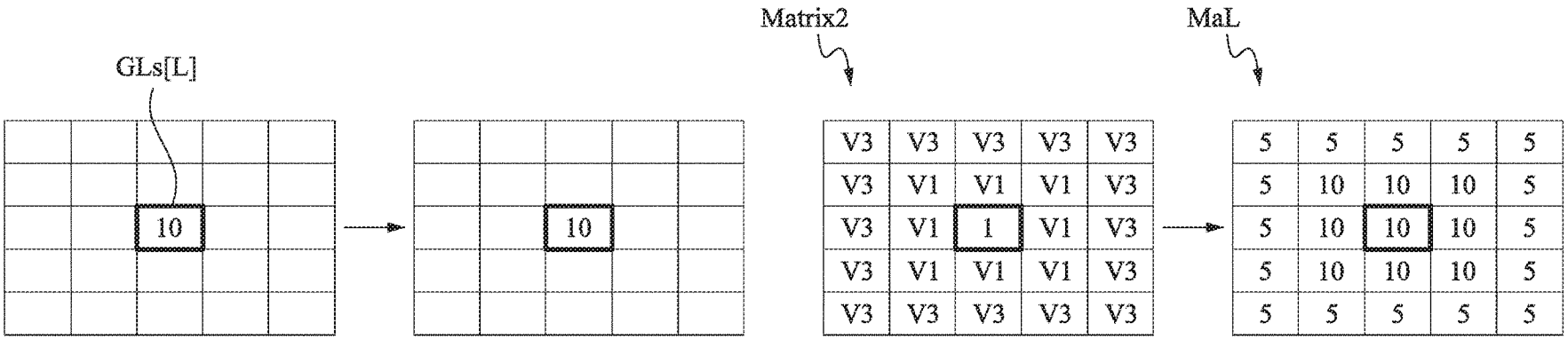
FIG. 6B is a schematic diagram illustrating generating another gray-level matrix in accordance with some embodiments of the disclosure.

Specifically, in the present disclosure, the coefficient matrix Matrix1 and the coefficient matrix Matrix2 are 5×5 matrixes, as shown in FIG. 6A. In other words, the coefficient matrix Matrix1 and the coefficient matrix Matrix2 include 25 coefficients respectively. The coefficient in the center of the coefficient matrix Matrix1 is 1, the 8 coefficients surrounding the center of the coefficient matrix Matrix1 are V1, and the 16 coefficients in the marginal of the coefficient matrix Matrix1 are V2. The coefficient in the center of the coefficient matrix Matrix2 is 1, the 8 coefficients surrounding the center of the coefficient matrix Matrix2 are V1, and the 16 coefficients in the marginal of the coefficient matrix Matrix2 are V3. The coefficient V3 is smaller than or equal to the coefficient V2. In some embodiments, $0.75 \leq V1 \leq 1$, $0.52 \leq V2 \leq 0.75$, and $0 \leq V2 \leq 0.5$. For example, V1 is 1, V2 is 0.75 and V3 is 0.5. It should be noted that, the coefficients above are merely examples, and are not intended to limit the present disclosure.

For example, taking the brightness threshold TH as 15 as an example, as shown in FIG. 6A, when a gray level data signal GLs [H] in the LCD panel LCD2 is 186, since the gray level data signal GLs [H] is larger than the brightness threshold TH (i.e., 186>15), so the operational circuit 160 adjusts the gray level data signal GLs [H] to the maximum brightness value (i.e., 255), and multiplies the maximum brightness value by the coefficient matrix Matrix1 including coefficients 1, V1 and V2 to obtain the gray-level matrix (e.g., the matrix MaH shown in FIG. 6A). As another example, when a certain gray level data signal GLs [L] in the LCD panel LCD2 is 10, since the gray level data signal GLs [L] is less than the brightness threshold TH (i.e., 10<15), the operational circuit 160 does not adjust the gray level data signal GLs [L] and directly multiplies the gray level data signal GLs [L] by the coefficient matrix Matrix2 containing coefficients 1, V1, and V3 to obtain the gray-level matrix (e.g., the matrix MaL shown in FIG. 6B).

In other words, after operations S230, S240, S250*a*, and S250*b*, the operational circuit 160 will receive the scaled down gray level data signal GLs from the operational circuit 140 and generate a corresponding number of gray level matrices. It should be noted that the size, the overlapping distribution and sampling operation method of the pixel groups above, the value of the brightness threshold TH, and the number and value of the coefficients of the coefficient matrix Matrix1 and Matrix2 are only examples, and may be adjusted according to actual requirements, not intended to limit the present disclosure.

Next, in operation S260, the operational circuit 160 performs an overlapping (sum and shift) operation on the generated multiple gray-level matrices to obtain a backlight matrix. Specifically, the operational circuit 160 shifts the multiple gray-level matrices according to positions corresponding to their respective gray level data signals GLs, so that the respective center positions of the multiple gray-level matrices are located at the original gray level data signals GLs. The operational circuit 160 sums up the values at the same position to obtain the backlight matrices.

Figure 7:
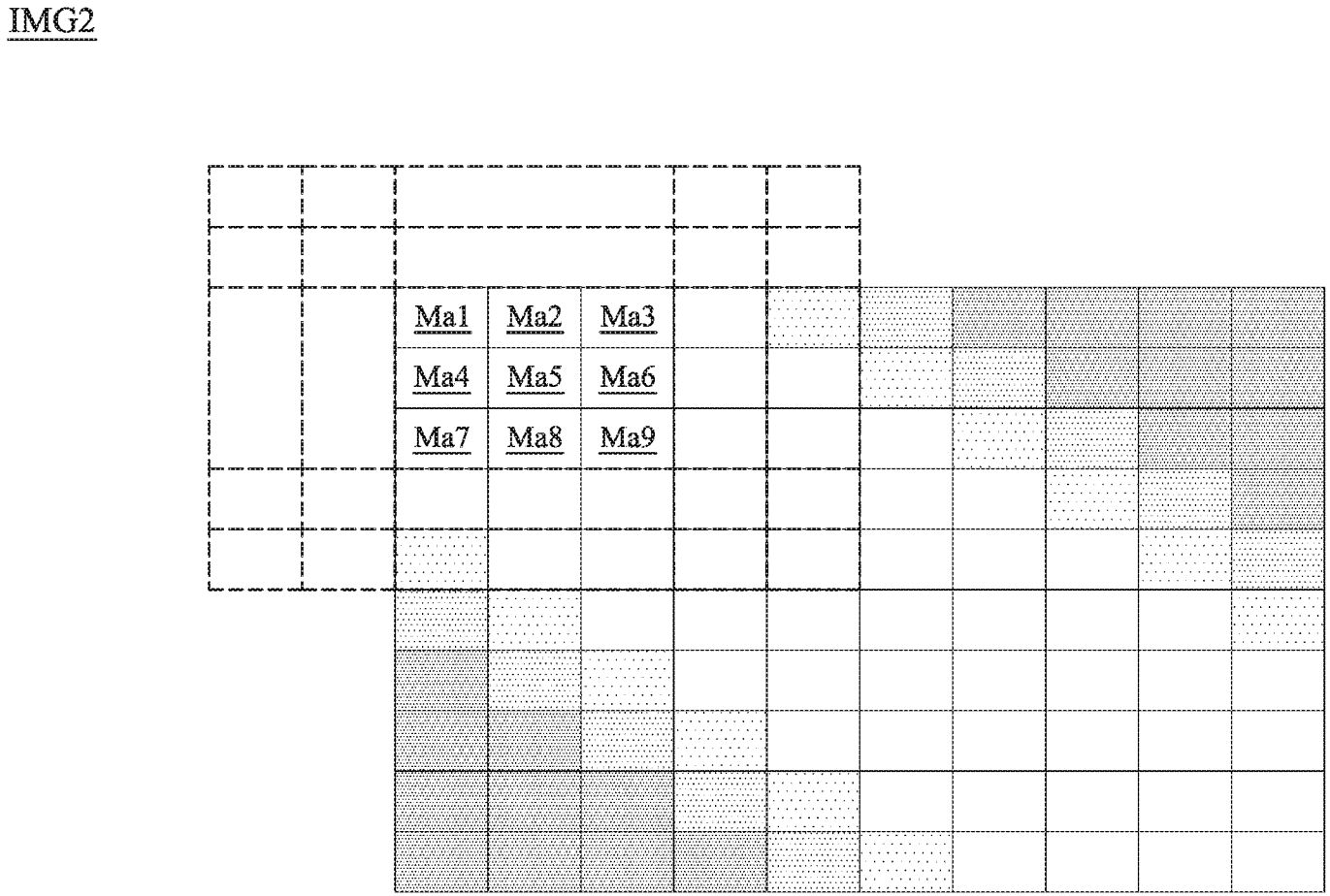
FIG. 7 is a schematic diagram illustrating an output image in accordance with some embodiments of the disclosure.

For example, the backlight matrix obtained from the input image IMG1 in FIG. 4 after the above operations is shown as the output image IMG2 in FIG. 7, in which Ma1~Ma9 are the gray-level matrices produced by the corresponding gray level data signals GLs [1]~GLs [9] in FIG. 5D. In addition, the input image IMG1 has a total number of pixels corresponding to the number of pixels of the LCD panel LCD2, and the output image IMG2 has a total number of pixels corresponding to the number of areas of the LCD panel LCD1. In other words, after operation S260, operational circuit 160 superimposes all gray-level matrices to obtain the output image IMG2, and generates corresponding driving signals according to the output image IMG2 to control the multiple areas of the LCD panel LCD1 (e.g., the pixel Px1 in FIG. 2A) to emit and display.

In this way, by the operational circuits 140 and 160 operating according to the backlight signal processing method, multiple color data signals RGB corresponding to the number of pixels of the LCD panel LCD2 are able to be converted into the backlight matrix corresponding to the number of areas of the LCD panel LCD1. And by controlling the LCD panel LCD1 and the LCD panel LCD2 to display respectively according to the backlight matrices and the color data signals RGB, the contrast is able to be effectively improved.

It should be noted that the total number or size of the pixels included in the input image IMG1 and the output image IMG2 may be adjusted according to actual requirements. FIGS. 4~7 are for illustration purposes only and are not intended to limit the present disclosure.

Figure 8A:
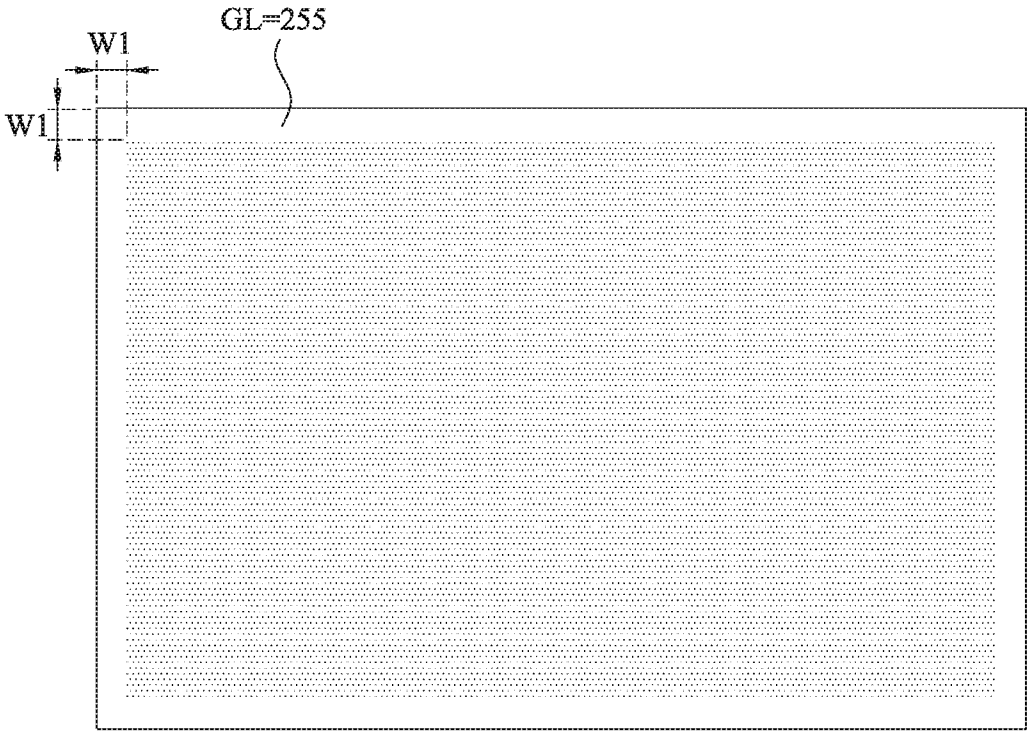
FIG. 8A and FIG. 8B are schematic diagrams illustrating a set of an input image and an output image in accordance with some embodiments of the disclosure.
Figure 8B:
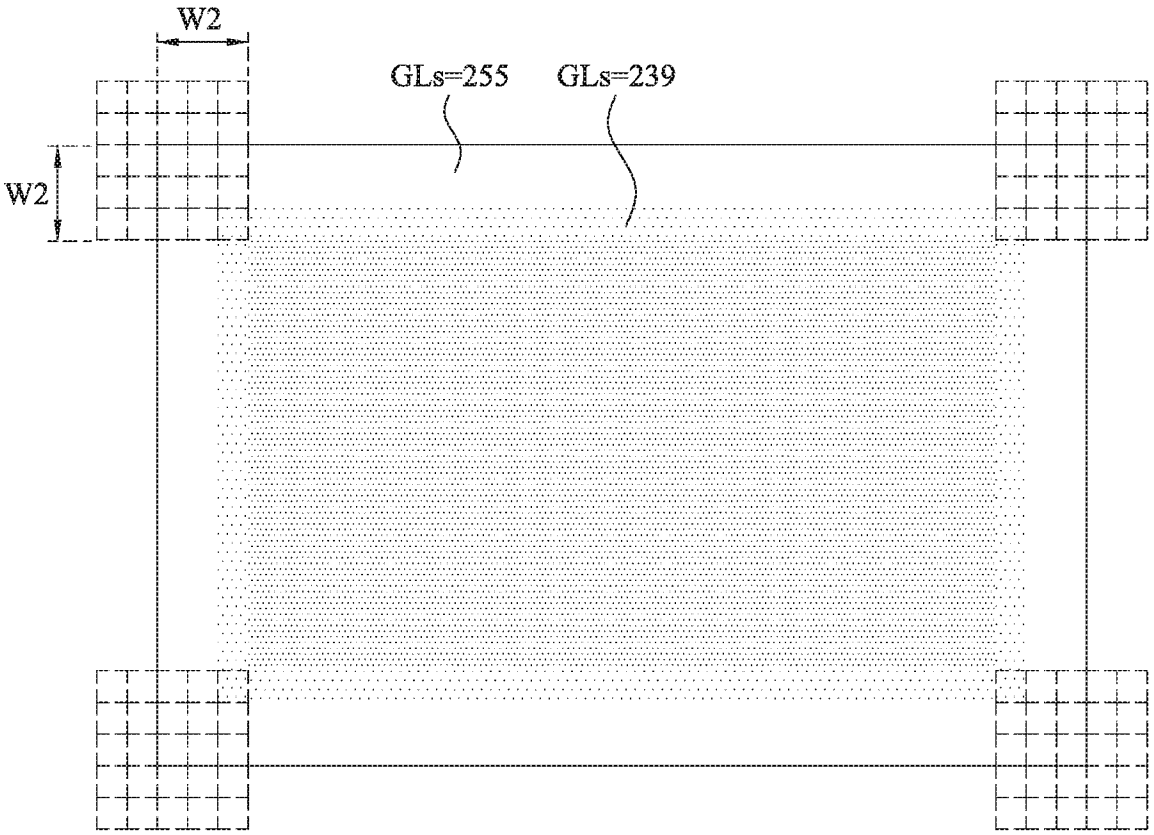

Please refer to FIGS. 8A and 8B. FIGS. 8A and 8B are schematic diagrams illustrating a set of the input image and the output image according to some embodiments of the disclosure. When the input image signal input to the display device 100 is as shown in FIG. 8A, the output image signal, by which the display device 100 converts and displays according to the input image signal, is as shown in FIG. 8B. The resolution of the output image signal is smaller than the resolution of the input image signal. The input image signal has a first total number of pixels and contains a first high-brightness pattern. The output image signal has a second total number of pixels and contains a second high-brightness pattern. The second total number of pixels is lower than the first total number of pixels, and the width of pixels of the second high-brightness pattern is larger than the width of pixels of the first high-brightness pattern.

Further, as shown in FIG. 8A, the first high-brightness pattern of the input image signal is a rectangle with a white frame on a black background, and the width W1 of the white frame in the rectangle is one pixel. Because the backlight signal processing method in the present disclosure retains all brightness data, and improves the brightness of pixels surrounding the each pixel with brightness data in the input image through the designed matrix calculation. Therefore, even if the pattern with brightness data in the input image has only one pixel width, the entire white borderline will be completely preserved during the calculation. And as shown in FIG. 8B, the second high-brightness pattern of the output image signal will be a rectangle with a white frame on a black background, and the width W2 of the white frame in the rectangle is three pixels (the width per unit pixel is as U1~U9 shown in FIG. 5D).

Figure 9A:
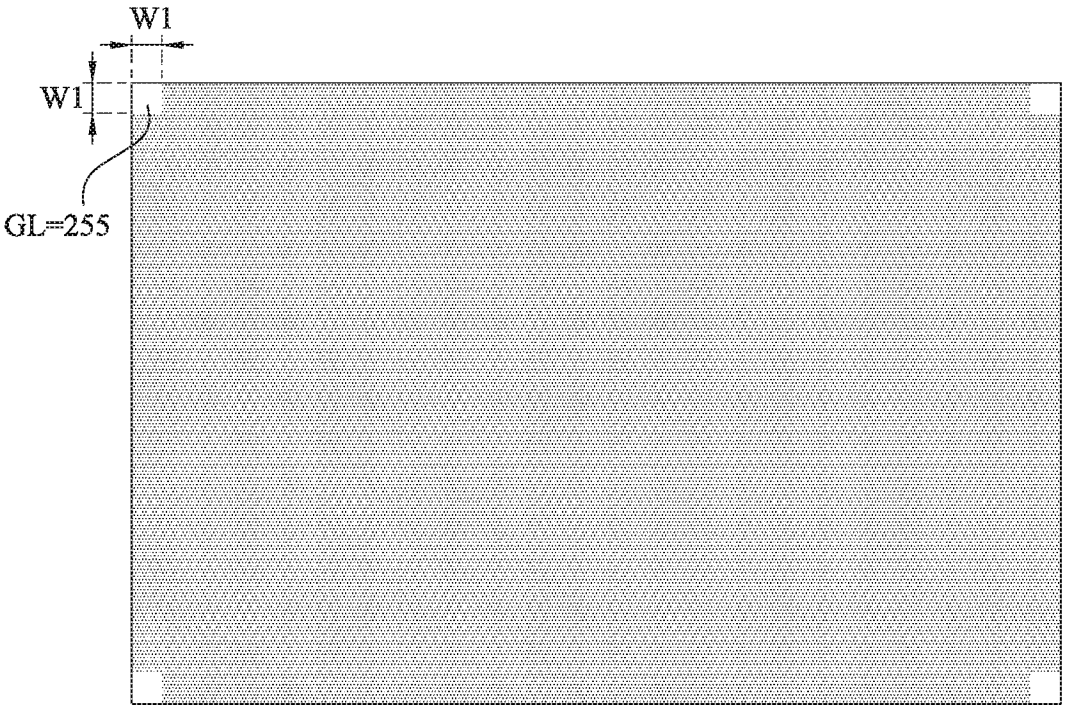
FIG. 9A and FIG. 9B are schematic diagrams illustrating another set of an input image and an output image in accordance with some embodiments of the disclosure.
Figure 9B:
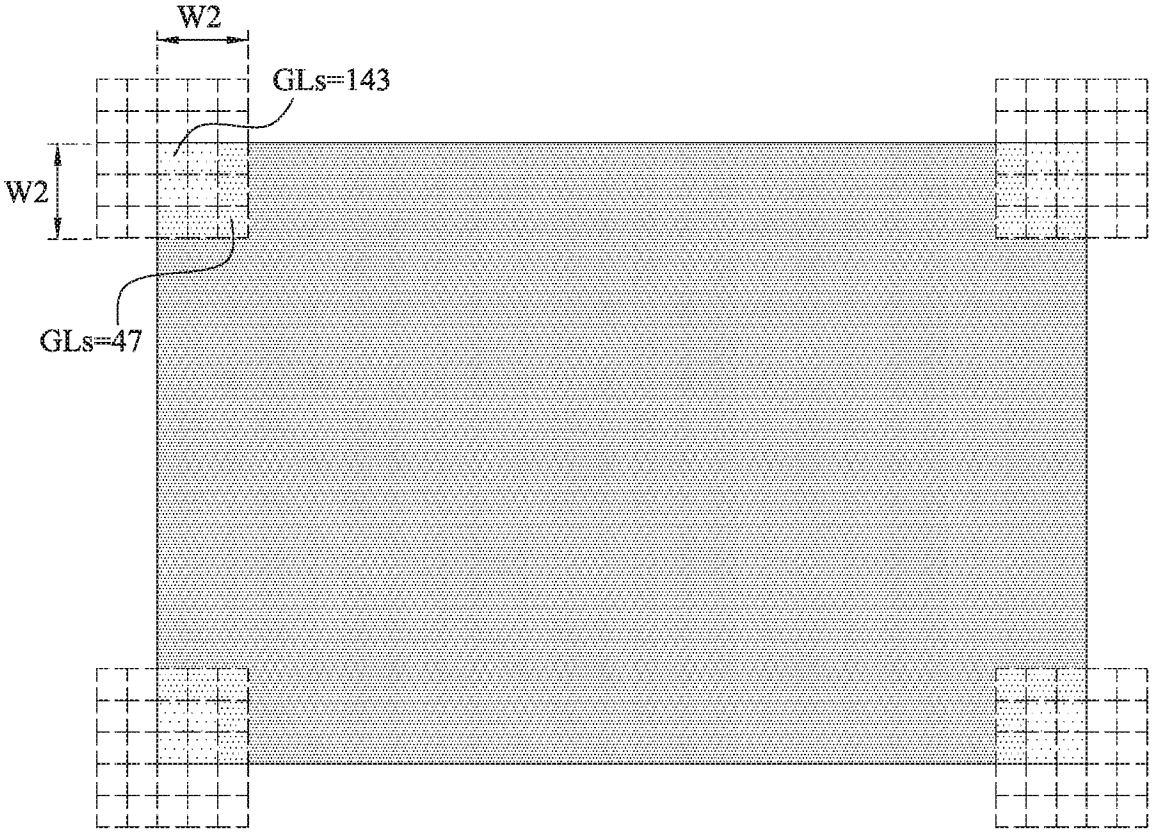

In some other embodiments, please refer to FIG. 9A and FIG. 9B. FIG. 9A and FIG. 9B are schematic diagrams illustrating another set of the input image and the output image according to some embodiments of the present disclosure. Similarly, when the input image signal input to the display device 100 is as shown in FIG. 9A, the output image signal converted and displayed by the display device 100 according to the input image signal is as shown in FIG. 9B. Further, as shown in FIG. 9A, the first high-brightness pattern of the input image signal is four white dots located at four corners of the display device 100, and the size of the four white dots is 1×1 pixels. As shown in FIG. 9B, the second high-brightness pattern of the output image signal is four squares at the four corners of the display device 100, and the size of the four squares is 3×3 pixels (the width of each unit pixel is as U1~U9 shown in FIG. 5D).

It should be noted that the sequence of execution of the processes in the foregoing flowcharts is merely an exemplary embodiment, not intended to limit to the present disclosure. Various alterations and modifications may be performed on the disclosure by those of ordinary skills in the art without departing from the principle and spirit of the disclosure. In the foregoing, exemplary operations are included. However, these operations do not need to be performed sequentially. The operations mentioned in the embodiment may be adjusted according to actual needs unless the order is specifically stated, and may even be performed simultaneously or partially simultaneously.

It is noted that, the drawings, the embodiments, and the features and circuits in the various embodiments may be combined with each other as long as no contradiction appears. The circuits illustrated in the drawings are merely examples and simplified for the simplicity and the ease of understanding, but not meant to limit the present disclosure. In addition, those skilled in the art can understand that in various embodiments, circuit units may be implemented by different types of analog or digital circuits or by different chips having integrated circuits. Components may also be integrated in a single chip having integrated circuits. The description above is merely by examples and not meant to limit the present disclosure.

In summary, in various embodiments of the present disclosure, by performing calculations according to the backlight signal processing method, multiple color data signals RGB corresponding to the number of pixels of the LCD panel LCD2 can be converted into a backlight matrix corresponding to the number of areas of the LCD panel LCD1. By controlling the LCD panel LCD1 and the LCD panel LCD2 to display respectively according to the backlight matrix and the color data signals RGB, the contrast can be effectively improved.

Although specific embodiments of the disclosure have been disclosed with reference to the above embodiments, these embodiments are not intended to limit the disclosure. Various alterations and modifications may be performed on the disclosure by those of ordinary skills in the art without departing from the principle and spirit of the disclosure. Thus, the protective scope of the disclosure shall be defined by the appended claims.

What is claimed is:

1. A backlight signal processing method, suitable for a display device including a backlight module and a LCD panel, wherein a number of a plurality of emitting areas of the backlight module is smaller than a number of a plurality of pixels of the LCD panel, the backlight signal processing method comprising:

generating a plurality of first gray level data signals according to a plurality of color data signals;

grouping the first gray level data signals to calculate a plurality of second gray level data signals, wherein a number of the second gray level data signals is smaller than a number of the first gray level data signals;

multiplying a coefficient matrix to obtain a plurality of gray level matrices;

performing an overlapping operation by shifting the plurality of gray level matrices according to positions respectively corresponding to the second gray level data signals, and summing up the plurality of gray level matrices to obtain a backlight matrix; and controlling the plurality of emitting areas to display according to the backlight matrix respectively.

2. The backlight signal processing method of claim 1, wherein any one of the plurality of color data signals comprises a first color value, a second color value and a third color value, generating any one of the plurality of first gray level data signals in the backlight signal processing method comprising:

taking the largest one of the first color value, the second color value and the third color value to be the first gray level data signal.

3. The backlight signal processing method of claim 1, wherein the plurality of the first gray level data signal corresponds to the plurality of emitting areas respectively, generating the plurality of second gray level data signals in the backlight signal processing method comprising:

mirroring and copying the plurality of first gray level data signals located in a surrounding area;

grouping the plurality of first gray level data signals according to N×N adjacent ones in the plurality of emitting areas, wherein N is a positive integer; and averaging ones in the same group of the plurality of first gray level data signals to generate a corresponding one of the plurality of second gray level data signals.

4. The backlight signal processing method of claim 1, wherein obtaining the plurality of gray level matrices comprises:

adjusting one in the plurality of second gray level data signals greater than or equal to a brightness threshold into a maximum brightness value and multiplying a first coefficient matrix to obtain the corresponding one of the plurality of gray level matrices; and multiplying one in the plurality of second gray level data signals that are smaller than the brightness threshold by a second coefficient matrix to obtain the corresponding one of the plurality of gray level matrices, wherein a first coefficient in the first coefficient matrix is greater than a second coefficient in the second coefficient matrix.

5. A backlight signal processing method, comprising:

when an input image signal is input to a display device, converting, by the display device, the input image signal into an output image signal, where a resolution of the output image signal is less than a resolution of the input image signal; and the input image signal comprising a first total number of pixels and a first high-brightness rectangle pattern with a first frame, the output image signal comprising a second high-brightness rectangle pattern with a second frame and a second total number of pixels which is lower than the first total number of pixels, a width of pixels of the second high-brightness rectangle pattern is larger than a width of pixels of the first high-brightness rectangle pattern.

6. The backlight signal processing method of claim 5, wherein the width of pixels of the first frame is one, and the width of pixels of the second frame is three.

7. A display device, comprising:

a backlight module, comprising a plurality of emitting areas;

a LCD panel, comprising a plurality of pixels, wherein a number of plurality of pixels is larger than a number of the plurality of emitting areas; and a control circuit, coupled to the backlight module and the LCD panel, the control circuit configured to perform the following operations:

generating a plurality of first gray level data signals according to a plurality of color data signals;

grouping the plurality of first gray level data signals to calculate a plurality of second gray level data signals, wherein a number of the plurality of second gray level data signals is smaller than a number of the plurality of first gray level data signals;

multiplying the plurality of second gray level data signals by a coefficient matrix to obtain a plurality of gray level matrices;

performing an overlapping operation by shifting the plurality of gray level matrices according to positions respectively corresponding to the second gray level data signals, and summing up the plurality of gray level matrices to obtain a backlight matrix;

controlling the plurality of emitting areas to display according to the backlight matrix respectively; and controlling the plurality of pixels to display according to the plurality of color data signals respectively.

8. The display device of claim 7, wherein the display device is configured to mirrored copy ones of the plurality of emitting areas located in a surrounding area among the plurality of first gray level data signals, and to group the plurality of first gray level data signals according to N×N adjacent ones in the plurality of emitting areas, and to average ones in the same group of the plurality of first gray level data signals to generate a corresponding one of the plurality of second gray level data signals, where N is a positive integer.

9. The display device of claim 7, wherein the display device is configured to multiply one in the plurality of second gray level data signals that are greater than or equal to a brightness threshold by a first coefficient matrix to obtain the corresponding one of the gray level matrices, and multiply one in the plurality of second gray level data signals that are smaller than the brightness threshold by a second coefficient matrix to obtain the corresponding one of the gray level matrices, wherein a first coefficient in the first coefficient matrix is greater than a second coefficient in the second coefficient matrix.

* * * * *